US007817089B2

(12) United States Patent
Wu et al.

(10) Patent No.: US 7,817,089 B2
(45) Date of Patent: Oct. 19, 2010

(54) BEAMFORMER USING CASCADE MULTI-ORDER FACTORS, AND A SIGNAL RECEIVING SYSTEM INCORPORATING THE SAME

(75) Inventors: Rong-Ching Wu, Dashu Township (TW); Ching-Tai Chiang, Dashu Township (TW)

(73) Assignee: I Shou University, Dashu Township (TW)

( * ) Notice: Subject to any disclaimer, the term of this patent is extended or adjusted under 35 U.S.C. 154(b) by 18 days.

(21) Appl. No.: 12/317,823

(22) Filed: Dec. 29, 2008

(65) Prior Publication Data

US 2009/0322609 A1 Dec. 31, 2009

(30) Foreign Application Priority Data

Jun. 30, 2008 (TW) ..... 97124540 A

(51) Int. Cl.
*H01Q 3/00* (2006.01)

(52) U.S. Cl. ..... 342/377; 342/368; 342/373

(58) Field of Classification Search ..... 342/368, 342/372, 373, 377, 378
See application file for complete search history.

(56) References Cited

U.S. PATENT DOCUMENTS

2007/0135051 A1* 6/2007 Zheng et al. ..... 455/63.1
2010/0046770 A1* 2/2010 Chan et al. ..... 381/92

* cited by examiner

*Primary Examiner*—Dao L Phan
(74) *Attorney, Agent, or Firm*—Townsend and Townsend and Crew, LLP

(57) ABSTRACT

A beamformer includes a number (T) of consecutive combining stages. A $T^{th}$ combining stage includes a converging unit. Each of first to $(T-1)^{th}$ combining stages includes a plurality of converging units. The number of the converging units in a preceding combining stage is greater than that of a succeeding combining stage. Each converging unit in the first combining stage combines three arrival signals from an antenna array in accordance with corresponding weights so as to form an output signal. Each converging unit in each of second to $(T-1)^{th}$ combining stages combines output signals of three corresponding converging units in an immediately preceding combining stage in accordance with corresponding weights so as to form an output signal. The converging unit of the $T^{th}$ combining stage combines the output signals from the converging units in the $(T-1)^{th}$ combining stage in accordance with corresponding weights so as to form an output signal that serves as an array pattern.

10 Claims, 9 Drawing Sheets

| FIG. 3A | FIG. 3B |
|---|---|

| FIG. 4A | FIG. 4B |
|---|---|

BEAMFORMER USING CASCADE MULTI-ORDER FACTORS, AND A SIGNAL RECEIVING SYSTEM INCORPORATING THE SAME

CROSS-REFERENCE TO RELATED APPLICATION

This application claims priority to Taiwanese Application No. 097124540, filed Jun. 30, 2008, the disclosure of which is incorporated herein by reference.

BACKGROUND OF THE INVENTION

1. Field of the Invention

The invention relates to a beamforming technique, more particularly to a beamformer using cascade multi-order factors, and a signal receiving system incorporating the same.

2. Description of the Related Art

Beamforming technology, in which a signal is multiplied with a complex weight so as to adjust magnitude and phase thereof, is used in smart antennas for both transmission and reception. Since beamforming is normally implemented using digital signal processing (DSP) techniques, the complex weight must be quantized, resulting in weight quantization error, which often affects beamforming performance and system stability (such as in terms of zeros), and hence degrades communication quality.

Referring to FIG. 1, a carrier signal from a transmitting end (not shown) enters a conventional smart antenna 8 at an arrival angle (θ) relative to a broadside of the conventional smart antenna 8. The conventional smart antenna 8 includes a linear array of a number (N) of isotropic antenna units with uniform spacing, where (N) is a positive integer. An array pattern function obtained by combining output signals of the isotropic antennas, 1, $u^1$, $u^2$, . . . , $u^{N-1}$, with respective weights $w_0$, $w_1$, $w_2$, . . . , $w_{N-1}$, can be represented by the following equation:

$$P(u) = \sum_{n=0}^{N-1} w_n u^n.$$

Assuming that the array pattern function P(u) has a number (N−1) of first order zeros, $z_1$, $z_2$, . . . , $z_{N-1}$, then the array pattern function P(u) can also be represented by the following equation:

$$P(u) = w_{N-1} \prod_{i=1}^{N-1} (u - z_i).$$

Equations (1) and (2) below are partial derivatives of the array pattern function P(u) respectively with respect to a particular weight $w_n$ and a particular zero $z_i$, i.e., $$\frac{\partial P(u)}{\partial w_n} \text{ and } \frac{\partial P(u)}{\partial z_i},$$

where n=0, 1, 2, . . . , N−1 and i=0, 1, 2, . . . , N−1. An expression of $$\frac{\partial z_i}{\partial w_n}$$

is obtained using Equations (1) and (2), and is shown in Equation (3).

$$\frac{\partial P(u)}{\partial w_n} = u^n \tag{1}$$

$$\frac{\partial P(u)}{\partial z_i} = -w_{N-1} \prod_{k=1,k\neq i}^{N-1} (u - z_k) \tag{2}$$

$$\frac{\partial z_i}{\partial w_n} = \frac{\left.\frac{\partial P(u)}{\partial w_n}\right|_{u=z_i}}{\left.\frac{\partial P(u)}{\partial z_i}\right|_{u=z_i}} = \frac{-(z_i)^n}{w_{N-1} \prod_{k=1,k\neq i}^{N-1} (z_i - z_k)} \tag{3}$$

As seen from Equation (3), changes in each weight $w_n$ affect all the zeros $z_1, z_2, \ldots, z_{N-1}$ of the array pattern function P(u) implemented by the conventional smart antenna 8. Such changes in the weights $w_n$ may arise when, for example, the weights $w_{x,t}$ are generated according to different quantization wordlengths.

A total displacement for a particular zero $z_i$ (i.e., a zero displacement $\Delta z_i$) can be expressed as a sum of all zero shifts due to the quantization errors of all of the weights $w_0$, $w_1$, $w_2$, . . . , $w_{N-1}$, i.e., $$\Delta z_i = \sum_{n=0}^{N-1} \frac{\partial z_i}{\partial w_n} \Delta w_n,$$

where i=0, 1, 2, . . . , N−1. By substituting Equation (3) into the above equation for the zero displacement $\Delta z_i$, it can be obtained that $$\Delta z_i = \sum_{n=0}^{N-1} \frac{-(z_i)^n}{w_{N-1} \prod_{k=1,k\neq i}^{N-1} (z_i - z_k)} \Delta w_n.$$

Therefore, a quantitative measure ($Q_{prior}$) for the effect of weight quantization error on the array pattern function P(u) implemented by the conventional smart antenna 8 can be defined by Equation (4) below:

$$Q_{prior} = \sum_{i=1}^{N-1} |\Delta z_i| = \sum_{i=1}^{N-1} \left| \sum_{n=0}^{N-1} \frac{(z_i)^n}{w_{N-1} \prod_{k=1,k\neq i}^{N-1} (z_i - z_k)} \Delta w_n \right| \tag{4}$$

From Equation (4), it is evident that, when the zeros $z_1 \sim z_{N-1}$ are clustered in the array pattern function P(u), $$\prod_{k=1,k\neq i}^{N-1} (z_i - z_k)$$

induces a huge variation on the quantitative measure ($Q_{prior}$) for the effect of weight quantization error. Consequently, the zero displacement $\Delta z_i$ is highly sensitive to the weight quantization error $\Delta w_n$, which adversely affects communication quality of the conventional smart antenna 8 such that the communication quality easily deviates from system requirements and specification.

SUMMARY OF THE INVENTION

Therefore, the object of the present invention is to provide a cascade beamformer using multi-order factors, and a signal receiving system incorporating the same so as to improve signal communication quality, and to minimize sensitivity on zeros due to weight quantization error under a premise that all weights have identical quantization wordlengths.

According to one aspect of the present invention, there is provided a signal receiving system that includes an antenna array, a weight generator, and a beamformer.

The antenna array includes a plurality of uniformly spaced apart antenna units.

The weight generator generates a plurality of weights.

The beamformer combines arrival signals outputted by the antenna units, and outputs an array pattern.

The beamformer includes a number (T) of consecutive combining stages. A $T^{th}$ one of the combining stages includes a converging unit. Each of first to $(T-1)^{th}$ ones of the combining stages includes a plurality of converging units. The number of the converging units in a preceding one of the combining stages is greater than that of a succeeding one of the combining stages.

Moreover, each of the converging units in the first one of the combining stages combines at least three of the arrival signals in accordance with corresponding ones of the weights so as to form an output signal. Each of the converging units in each of second to $(T-1)^{th}$ ones of the combining stages combines output signals of at least three corresponding ones of the converging units in an immediately preceding one of the combining stages in accordance with corresponding ones of the weights so as to form an output signal. The converging unit of the $T^{th}$ one of the combining stages combines the output signals from the converging units in the $(T-1)^{th}$ one of the combining stages in accordance with corresponding ones of the weights so as to form an output signal that serves as the array pattern.

According to another aspect of the present invention, there is provided a beamformer that is adapted for receiving arrival signals from an antenna array and a plurality of weights, and that is adapted for combining the arrival signals and outputting an array pattern.

The beamformer includes a number (T) of consecutive combining stages. A $T^{th}$ one of the combining stages includes a converging unit. Each of first to $(T-1)^{th}$ ones of the combining stages includes a plurality of converging units. The number of the converging units in a preceding one of the combining stages of the beamformer is greater than that of a succeeding one of the combining stages of the beamformer.

Moreover, each of the converging units in the first one of the combining stages combines at least three of the arrival signals in accordance with corresponding ones of the weights from the weight generator so as to form an output signal. Each of the converging units in each of second to $(T-1)^{th}$ ones of the combining stages combines output signals of at least three corresponding ones of the converging units in an immediately preceding one of the combining stages in accordance with corresponding ones of the weights from the weight generator so as to form an output signal. The converging unit of the $T^{th}$ one of the combining stages combines the output signals from the converging units in the $(T-1)^{th}$ one of the combining stages in accordance with corresponding ones of the weights from the weight generator so as to form an output signal that serves as the array pattern.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
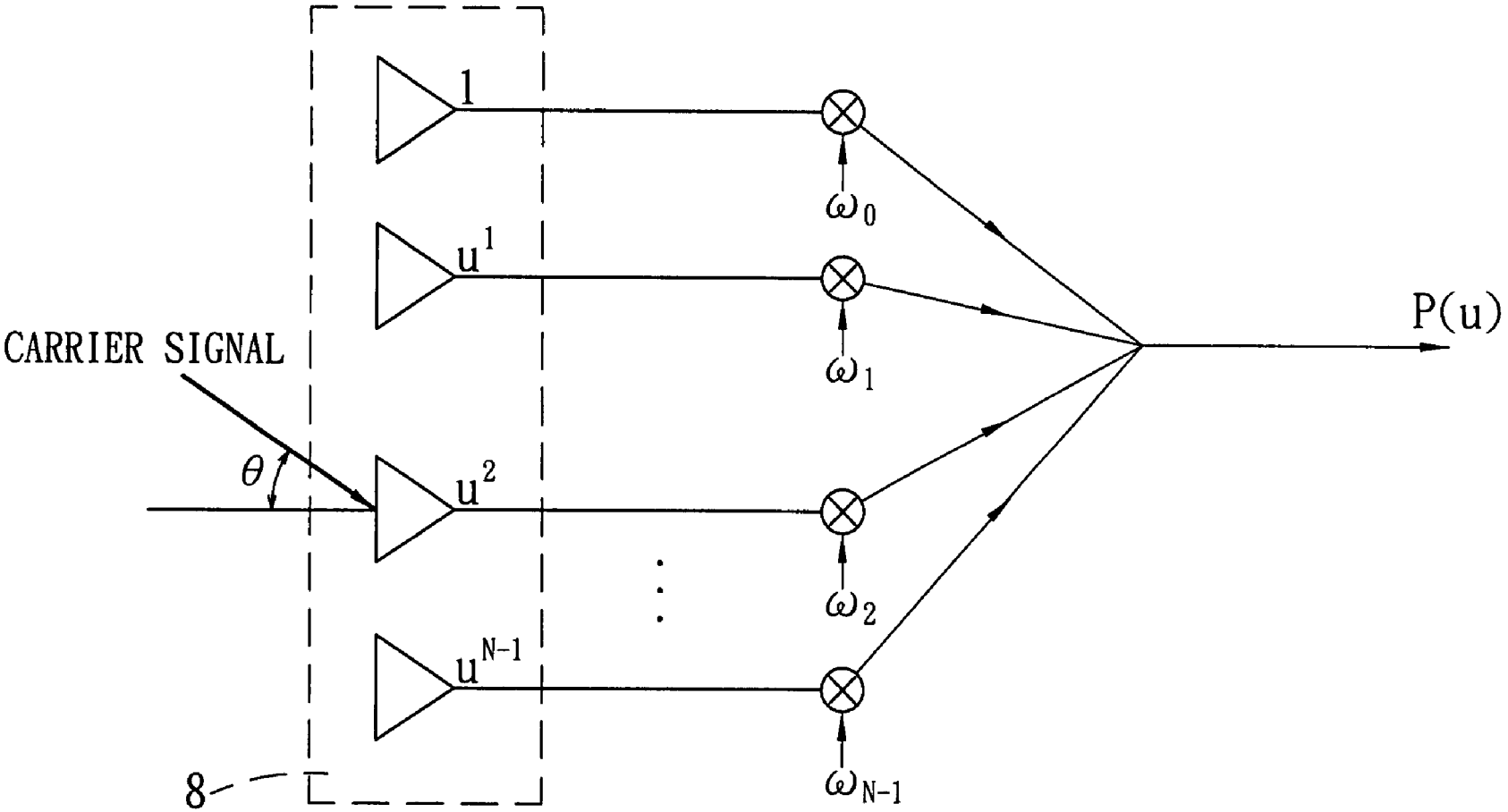
FIG. 1 PRIOR ART
FIG. 1 is a schematic diagram, illustrating a conventional smart antenna, where a carrier signal enters at an arrival angle (θ) relative to a broadside thereof.
Figure 2:
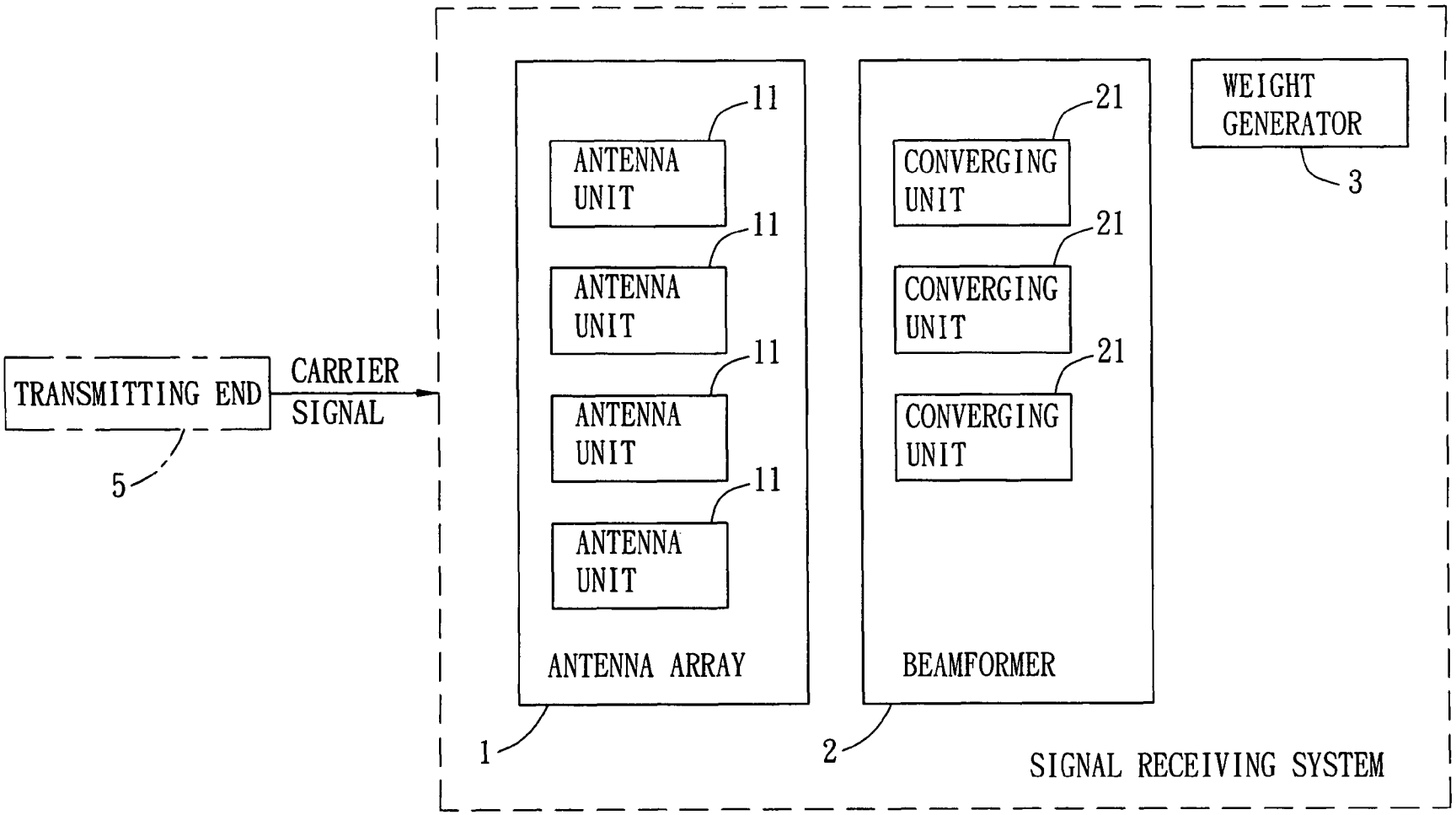
FIG. 2 is a block diagram of the preferred embodiment of a signal receiving system according to the present invention.
Figures 3, 3A:
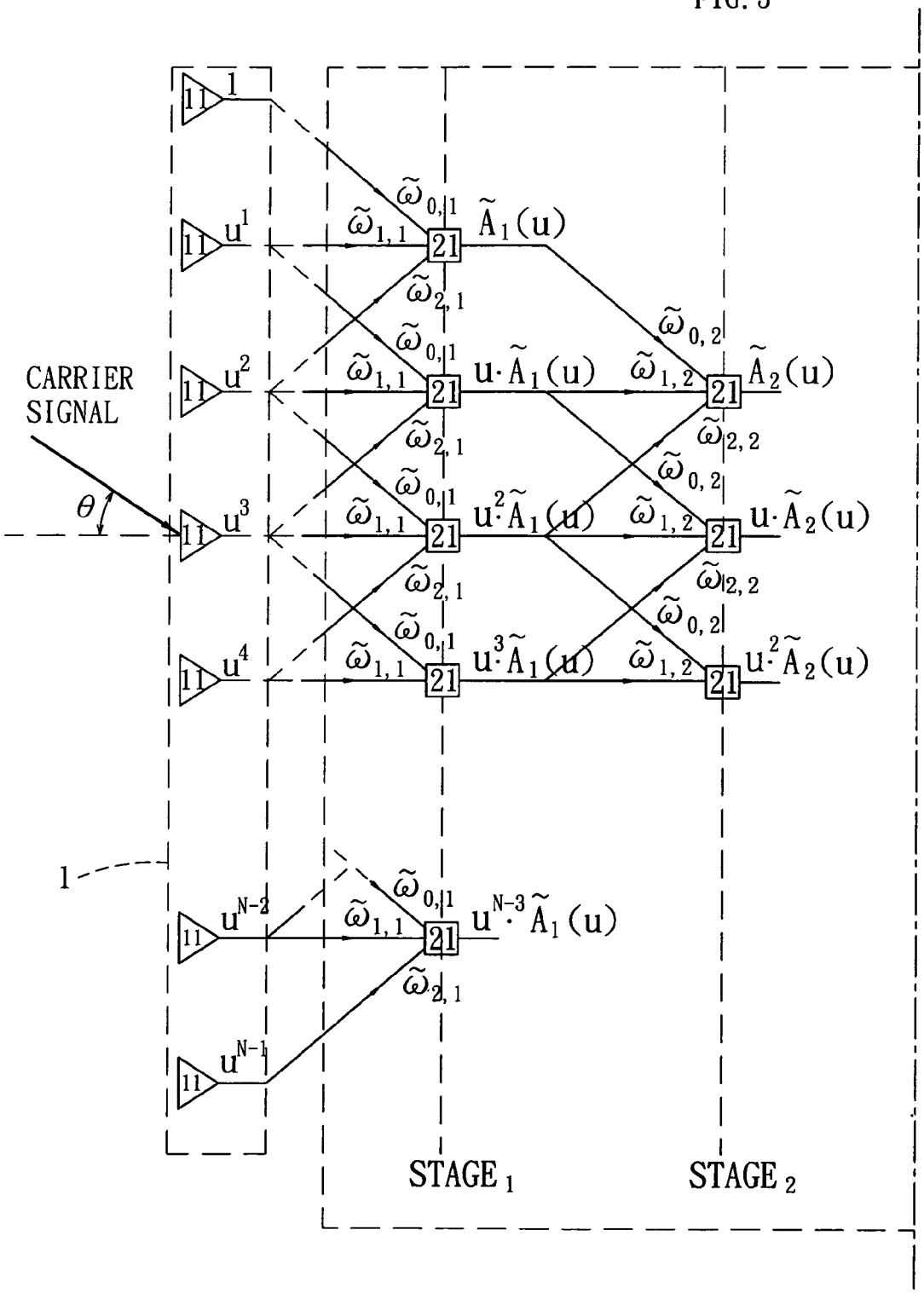
FIG. 3, which consists of two sub-parts.
FIGS. 3A and 3B, is a schematic diagram of the preferred embodiment, where a beamformer is implemented using cascade second-order factors, and an antenna array has an odd-number of antenna units.
Figure 3B:
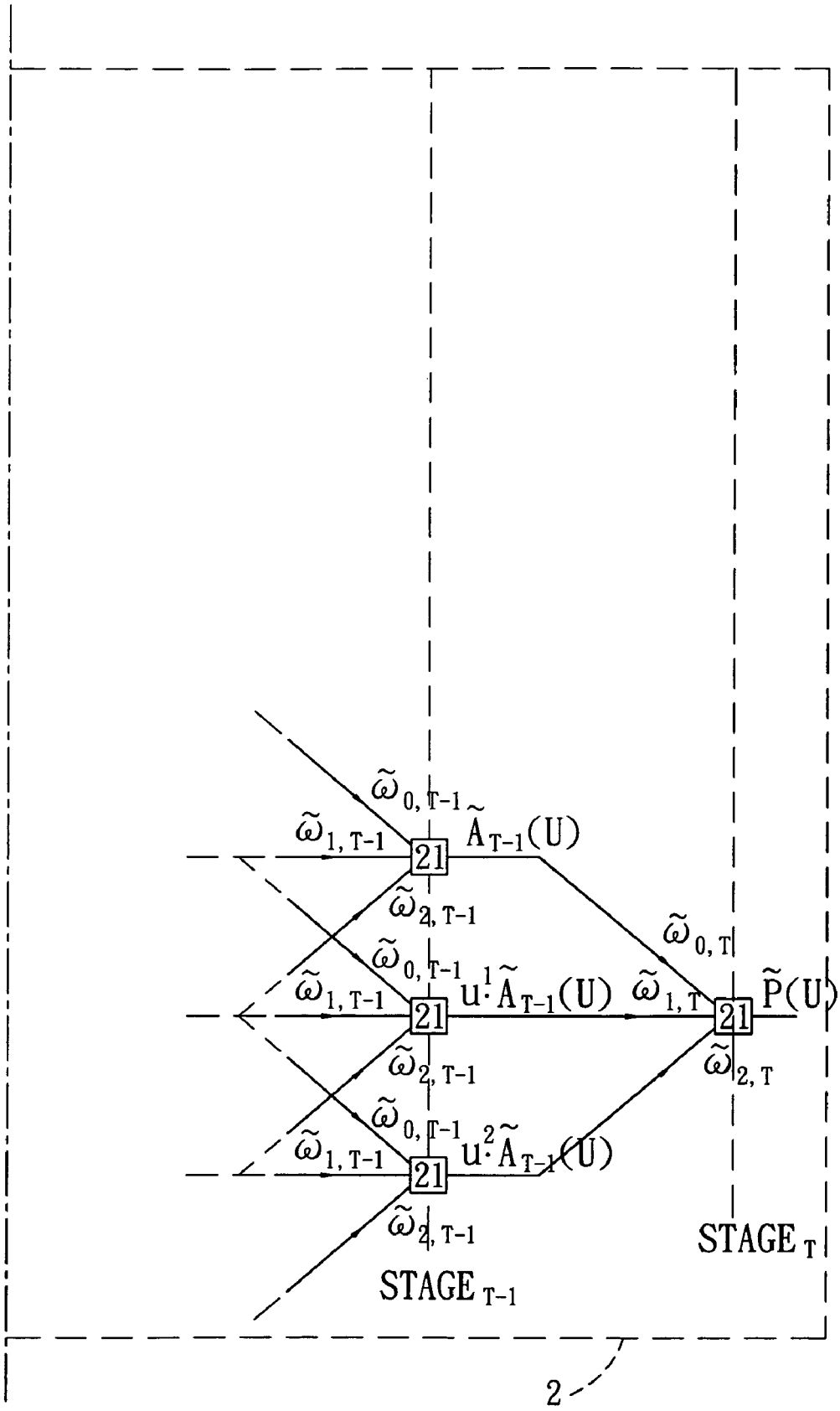

Referring to FIG. 2 and FIG. 3, the preferred embodiment of a signal receiving system according to the present invention is shown to be adapted for receiving a carrier signal from a transmitting end 5, wherein the carrier signal enters the signal receiving system at an angle (θ). The signal receiving system includes an antenna array 1, a weight generator 3, and a beamformer 2. The antenna array 1 includes a number (N) of uniformly spaced apart antenna units 11, which receive the carrier signal at varying times, and each of which outputs an arrival signal. The arrival signals outputted by the antenna units 11 are linearly phase related, have factor relationships among each other, and thus can be represented as 1, $u^1$, $u^2 \ldots u^{N-1}$, where $u(\theta)=\exp[j2\pi d \sin(\theta)/\lambda]$, (d) is an antenna spacing between an adjacent pair of the antenna units 11, and (λ) is the wavelength of the arrival signals (or wavelength of the carrier signal).

Figures 4, 4A:
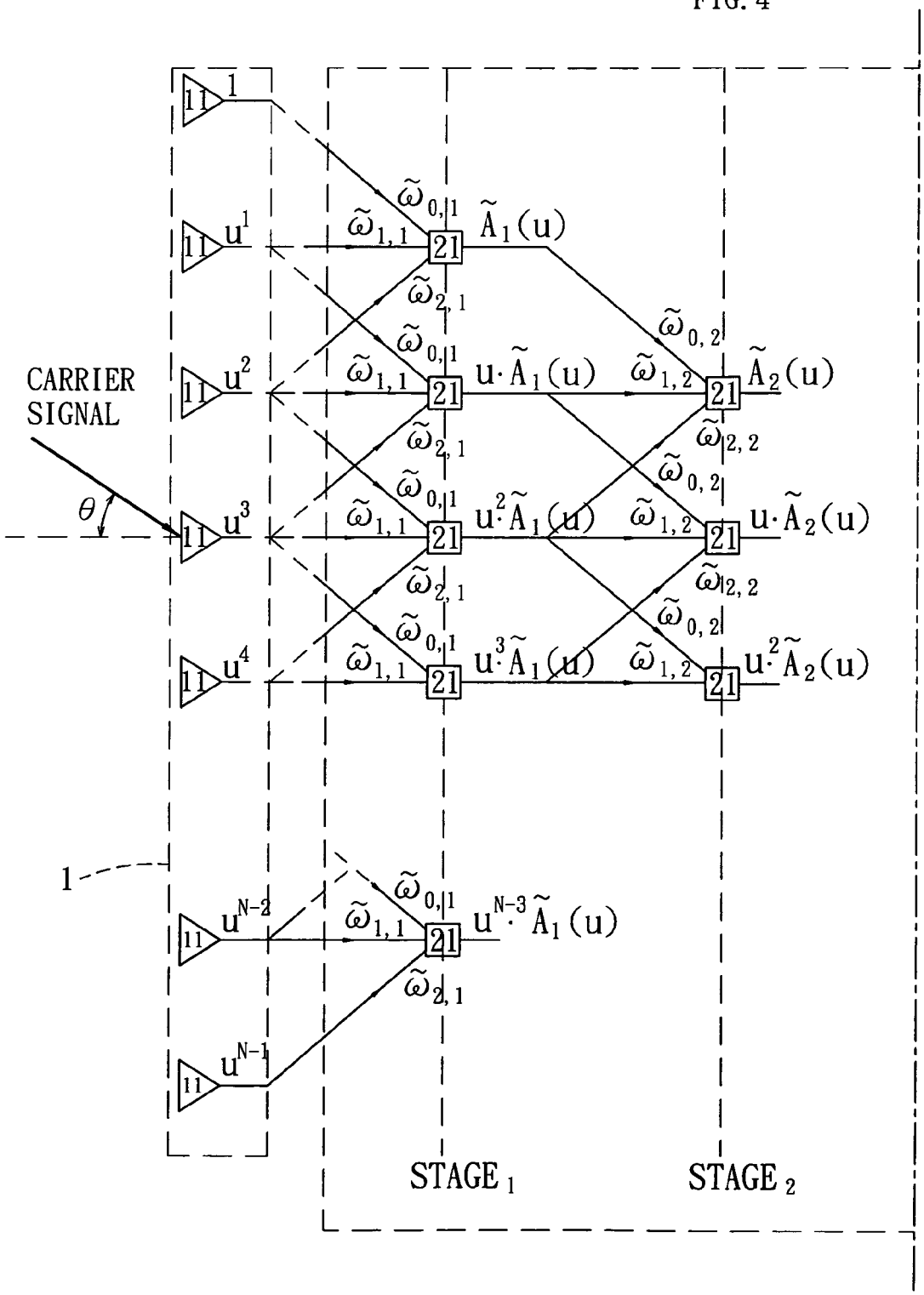
FIG. 4, which consists of two sub-parts.
FIGS. 4A and 4B, is a schematic diagram of the preferred embodiment, where the beamformer is implemented using cascade second-order factors, and the antenna array has an even-number of the antenna units.
Figure 4B:
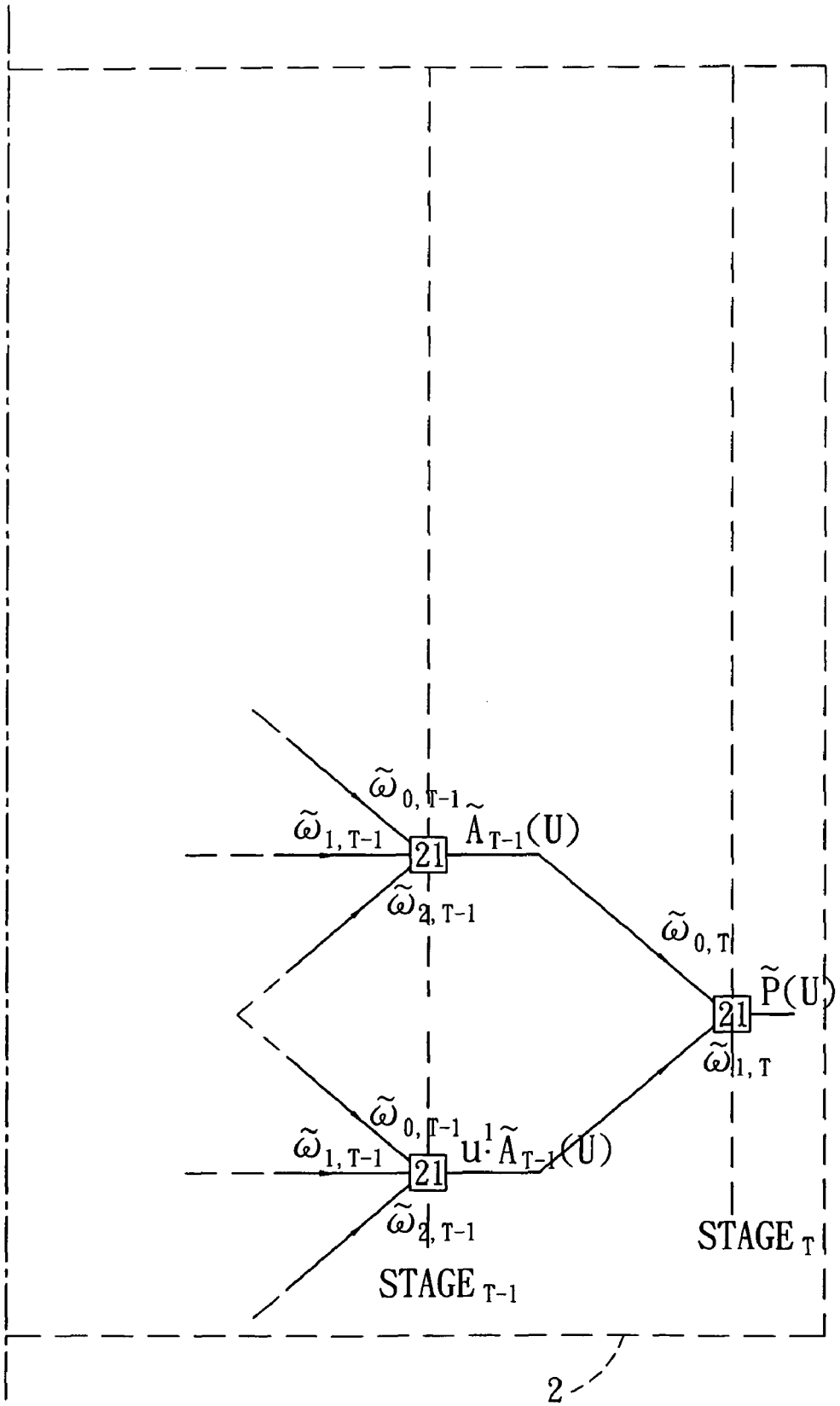

Since the signal receiving system processes the arrival signals in a digital manner, the beamformer 2 and the weight generator 3 need to operate using quantized values. The beamformer 2 combines the arrival signals through a number (T) of cascaded combining stages ($STAGE_1$), ($STAGE_2$), . . . , ($STAGE_T$) so as to output an array pattern function $\tilde{P}(u)$, where $T=\lfloor N/2 \rfloor$, which is the greatest integer not larger than N/2. A $T^{th}$ one of the combining stages ($STAGE_T$) includes a converging unit 21. Each of first to $(T-1)^{th}$ ones of the combining stages ($STAGE_1$)~($STAGE_{T-1}$) includes a number (N−2i) of the converging units 21, where i=1, 2, . . . , (T−1), respectively. In addition, the number of the converging units 21 in a preceding one of the combining stages ($STAGE_t$) (t=1, 2 . . . T) of the beamformer 2 is greater than that of a succeeding one of the combining stages ($STAGE_{t+1}$) (t=1, 2 . . . T) of the beamformer 2. When (N) is an odd number, the number of the converging units 21 of the $(T-1)^{th}$ one of the combining stages ($STAGE_{T-1}$) is three, as best shown in FIG. 3. On the other hand, when (N) is an even number, the number of the converging units 21 of the $(T-1)^{th}$ one of the combining stages ($STAGE_{T-1}$) is two, as best shown in FIG. 4.

According to the arrival angle (θ) of the carrier signal, for each of the combining stages ($STAGE_t$) (t=1, 2 . . . T), the weight generator 3 provides an identical set of quantized weights $\tilde{w}_{0,1}, \tilde{w}_{1,1}, \tilde{w}_{2,1}; \tilde{w}_{0,2}, \tilde{w}_{1,2}, \tilde{w}_{2,2}; \ldots; \tilde{w}_{0,T}, \tilde{w}_{1,T}, \tilde{w}_{2,T}$ to each of the converging units 21 in the particular combining stage ($STAGE_t$). Specifically, $\tilde{w}_{0,1}, \tilde{w}_{1,1}, \tilde{w}_{2,1}$ form the set of quantized weights provided to the converging units 21 of the first one of the combining stages ($STAGE_1$), $\tilde{w}_{0,2}, \tilde{w}_{1,2}, \tilde{w}_{2,2}$ form the set of quantized weights provided to the converging units 21 of the second one of the combining stages ($STAGE_2$), and $\tilde{w}_{0,T}, \tilde{w}_{1,T}, \tilde{w}_{2,T}$ form the set of quantized weights provided to the converging unit 21 of the $T^{th}$ one of the combining stages ($STAGE_T$). Each of the quantized weights $\tilde{w}_{0,1} \sim \tilde{w}_{2,T}$ has a magnitude component and a phase component. Each of the converging units 21 changes a magnitude of a signal received thereby according to the magnitude component of the corresponding one of the quantized weights $\tilde{w}_{0,1} \sim \tilde{w}_{2,T}$, and further changes a phase of the signal received thereby according to the phase component of the corresponding one of the quantized weights $\tilde{w}_{0,1} \sim \tilde{w}_{2,T}$ so as to output an output signal. As a result, after beamforming is completed by the beamformer 2, the array pattern function $\tilde{P}(u)$ is adjusted to an appropriate phase so as to form a maximum beam for a desired signal.

As shown in FIG. 3, the combining procedure of the beamformer 2 can be subdivided into the number (T) of combining stages: ($STAGE_1$), ($STAGE_2$), . . . , ($STAGE_T$).

Each of the converging units 21 in the first combining stage ($STAGE_1$) combines the arrival signals outputted by three corresponding adjacent ones of the antenna units 11 in accordance with corresponding ones of the weights $\tilde{w}_{0,1}, \tilde{w}_{1,1}, \tilde{w}_{2,1}$ from the weight generator 3 so as to form an output signal.

Each of the converging units 21 in each of the second to $(T-1)^{th}$ ones of the combining stages ($STAGE_2$)~($STAGE_{T-1}$) combines the output signals from three corresponding ones of the converging units 21 of the immediately preceding one of the combining stages ($STAGE_1$)~($STAGE_{T-2}$) in accordance with corresponding ones of the weights $\tilde{w}_{0,2}, \tilde{w}_{1,2}, \tilde{w}_{2,2}; \ldots; \tilde{w}_{0,T-1}, \tilde{w}_{1,T-1}, \tilde{w}_{2,T-1}$ from the weight generator 3 so as to form an output signal.

The converging unit 21 of the $T^{th}$ one of the combining stages ($STAGE_T$) combines the output signals from the converging units 21 of the $(T-1)^{th}$ one of the combining stages ($STAGE_{T-1}$) so as to form an output signal that serves as the array pattern function $\tilde{P}(u)$.

In each of the combining stages ($STAGE_t$) (t=1, 2 . . . T), each of the converging units 21 generates the output signal as a weighted sum of the three corresponding signals received thereby according to the corresponding quantized weights $\tilde{w}_{0,t}, \tilde{w}_{1,t}, \tilde{w}_{2,t}$ in a second-order fashion. In particular, the three arrival signals received by each of the converging units 21 in the first one of the combining stages ($STAGE_1$) are combined in a ratio of $1:u^1:u^2$, where $u=\exp[j2\pi d \sin(\theta)/\lambda]$, (d) is an antenna spacing between an adjacent pair of the antenna units 11, (λ) is the wavelength of a corresponding one of the arrival signals, and (θ) is the angle of a corresponding one of the arrival signals relative to a broadside of the antenna array 1. Moreover, the three output signals received by each of the converging units 21 in the second to $T^{th}$ ones of the combining stages ($STAGE_2$)~($STAGE_{T-1}$) are combined in the ratio of $1:u^1:u^2$. In other words, the three corresponding signals received by each of the converging units 21 of each of the combining stages ($STAGE_t$) have a second-order relationship in the factor of (u), i.e., the three corresponding signals are in the ratio of $1:u^1:u^2$. However, in the case where the number (N) of antenna units 11 is an even number, since there are only two converging units 21 in the $(T-1)^{th}$ one of the combining stages ($STAGE_{T-1}$), only two output signals are to be combined by the $T^{th}$ one of the combining stages ($STAGE_T$), and the weight $\tilde{w}_{2,T}$ would be set to zero. In this embodiment, the output signal of a first one of the converging units 21 in the first one of the combining stages ($STAGE_1$) is:

$$\tilde{w}_{0,1}+\tilde{w}_{1,1}u+\tilde{w}_{2,1}u^2=\tilde{A}_1(u);$$

the output signal of a second one of the converging units 21 in the first one of the combining stages ($STAGE_1$) is:

$$\tilde{w}_{0,1}u+\tilde{w}_{1,1}u^2+\tilde{w}_{2,1}u^3=u\cdot[\tilde{w}_{0,1}+\tilde{w}_{1,1}u+\tilde{w}_{2,1}u^2]=u\cdot\tilde{A}_1(u);$$

and the output signal of a third one of the converging units 21 in the first one of the combining stages ($STAGE_1$) is:

$$\tilde{w}_{0,1}u^2+\tilde{w}_{1,1}u^3+\tilde{w}_{2,1}u^4=u^2\cdot[\tilde{w}_{0,1}+\tilde{w}_{1,1}u+\tilde{w}_{2,1}u^2]=u^2\cdot\tilde{A}_1(u).$$

These three output signals $\tilde{A}_1(u)$, $u\cdot\tilde{A}_1(u)$, $u^2\cdot\tilde{A}_1(u)$ from the first one of the combining stages ($STAGE_1$), being in the ratio of $1:u^1:u^2$, are received by a first one of the converging units 21 of the second one of the combining stages ($STAGE_2$), and are combined into the corresponding output signal $\tilde{A}_2(u)$ by the first one of the converging units 21 of the second one of the combining stages ($STAGE_2$) according to the corresponding weights $\tilde{w}_{0,2}, \tilde{w}_{1,2}, \tilde{w}_{2,2}$ in the following manner:

$$\begin{aligned}\tilde{A}_2(u) &= \tilde{w}_{0,2}\tilde{A}_1(u)+\tilde{w}_{1,2}u\tilde{A}_1(u)+\tilde{w}_{2,2}u^2\tilde{A}_1(u)\\ &= [\tilde{w}_{0,2}\tilde{A}_1(u)]+[\tilde{w}_{1,2}\tilde{A}_1(u)]\cdot u+[\tilde{w}_{2,2}\tilde{A}_1(u)]\cdot u^2.\end{aligned}$$

It follows that the output signals outputted by the converging units 21 of each of the combining stages ($STAGE_1$)~($STAGE_T$) are in the ratio of $1:u^1:u^2:u^3: \ldots$. In other words, the output signals outputted by the converging units 21 of each of the combining stages ($STAGE_1$)~($STAGE_T$) are linearly phase related.

Therefore, the array pattern function $\tilde{P}(u)$ obtained by the present invention for the case where the number (N) of antenna units 11 is an odd number can be represented by Equation (5) that follows:

$$\begin{aligned}\tilde{P}(u) &= \tilde{w}_{0,T}\cdot[\tilde{A}_{T-1}(u)]+\tilde{w}_{1,T}[u^1\cdot\tilde{A}_{T-1}(u)]+\tilde{w}_{2,T}[u^2\cdot\tilde{A}_{T-1}(u)] \quad (5)\\ &= [\tilde{w}_{0,T}+\tilde{w}_{1,T}u+\tilde{w}_{2,T}u^2]\cdot[\tilde{A}_{T-1}(u)]\\ &= [\tilde{w}_{0,T}+\tilde{w}_{1,T}u+\tilde{w}_{2,T}u^2]\cdot[\tilde{w}_{0,T-1}+\tilde{w}_{1,T-1}u+\tilde{w}_{2,T-1}u^2]\cdot\\ &\quad [\tilde{A}_{T-2}(u)]\\ &= \prod_{t=1}^{T}[\tilde{w}_{0,t}+\tilde{w}_{1,t}u+\tilde{w}_{2,t}u^2]\end{aligned}$$

Since each of the combining stages ($STAGE_1$)~($STAGE_T$) involves a combination using second-order factors, it can be assumed that the array pattern function $\tilde{P}(u)$ has a number (2T) of quantized zeros, namely, $\tilde{z}_{1,1}, \tilde{z}_{2,1}; \tilde{z}_{1,2}, \tilde{z}_{2,2}; \ldots; \tilde{z}_{1,T},$ $\tilde{z}_{2,T}$, and the array pattern function $\tilde{P}(u)$ can therefore be rewritten as Equation (6) below:

$$\tilde{P}(u) = \prod_{t=1}^{T} \tilde{w}_{2,t}(u - \tilde{z}_{1,t})(u - \tilde{z}_{2,t}) \tag{6}$$

Under ideal conditions, there is no quantization error, i.e., $\tilde{w}_{x,t}=w_{x,t}+\Delta w_{x,t}$, $\tilde{z}_{m,t}+z_{m,t}+\Delta z_{m,t}$, $\tilde{P}(u)=P(u)+\Delta P(u)$, where $\Delta w_{x,t}=0$, $\Delta z_{m,t}=0$, $\Delta P(u)=0$, x=0, 1, 2, m=1, 2, t=1, 2, . . . , T. Consequently, Equations (5) and (6) can be respectively written as Equations (7) and (8) below:

$$P(u) = \prod_{t=1}^{T} [w_{0,t} + w_{1,t}u + w_{2,t}u^2] \tag{7}$$

$$P(u) = \prod_{t=1}^{T} w_{2,t}(u - z_{1,t})(u - z_{2,t}) \tag{8}$$

Moreover, the partial derivative of the array pattern function P(u) with respect to a particular weight $w_{x,t}$, i.e., $$\frac{\partial P(u)}{\partial w_{x,t}},$$

is as shown in Equation (9), and the partial derivatives of the array pattern function P(u) with respect to the particular zeros $z_{1,t}$ and $z_{2,t}$, i.e., $$\frac{\partial P(u)}{\partial z_{1,t}},$$

and $$\frac{\partial P(u)}{\partial z_{2,t}},$$

are as shown in Equations (10) and (11). Therefore, $$\frac{\partial z_{1,t}}{\partial w_{x,t}}$$

can be obtained using Equations (9) and (10), and is expressed in Equation (12) below, and $$\frac{\partial z_{2,t}}{\partial w_{x,t}}$$

can be obtained using Equations (9) and (11), and is expressed in Equation (13) below.

$$\frac{\partial P(u)}{\partial w_{x,t}} = u^x \prod_{k=1,k\neq t}^{T} w_{2,k}(u - z_{1,k})(u - z_{2,k}) \tag{9}$$

$$\frac{\partial P(u)}{\partial z_{1,t}} = -w_{2,t}(u - z_{2,t}) \prod_{k=1,k\neq t}^{T} w_{2,k}(u - z_{1,k})(u - z_{2,k}) \tag{10}$$

-continued $$\frac{\partial P(u)}{\partial z_{2,t}} = -w_{2,t}(u - z_{1,t}) \prod_{k=1,k\neq t}^{T} w_{2,k}(u - z_{1,k})(u - z_{2,k}) \tag{11}$$

$$\frac{\partial z_{1,t}}{\partial w_{x,t}} = \frac{\left.\frac{\partial P(u)}{\partial w_{x,t}}\right|_{u=z_{1,t}}}{\left.\frac{\partial P(u)}{\partial z_{1,t}}\right|_{u=z_{1,t}}} = \frac{-z_{1,t}^{x}}{w_{2,t}(z_{1,t} - z_{2,t})} \tag{12}$$

$$\frac{\partial z_{2,t}}{\partial w_{x,t}} = \frac{\left.\frac{\partial P(u)}{\partial w_{x,t}}\right|_{u=z_{2,t}}}{\left.\frac{\partial P(u)}{\partial z_{2,t}}\right|_{u=z_{2,t}}} = \frac{-z_{2,t}^{x}}{w_{2,t}(z_{2,t} - z_{1,t})} \tag{13}$$

As evident from Equations (12) and (13), the zeros $z_{m,t}$ of the array pattern function P(u) vary with changes in the weights $w_{x,t}$. In particular, changes in each of the weights $w_{x,t}$ only affect the corresponding pair of the zeros $z_{1,t}$, $z_{2,t}$ in the corresponding second-order factor that includes the weight $w_{x,t}$. Such changes in the weights $w_{x,t}$ may arise where, for example, the weight generator 3 generates the quantized weights $w_{x,t}$ according to different quantization wordlengths.

Moreover, a quantitative measure ($Q_{present}$) for the effect of the weight quantization error on the array pattern function $\tilde{P}(u)$ obtained by the present invention is defined as all zero displacements $\Delta z_{m,t}$ generated by the weight quantization errors $\Delta w_{x,t}$. In other words, the quantitative measure ($Q_{present}$) for the effect of the weight quantization error on the array pattern function $\tilde{P}(u)$ increases with increasing zero displacements $\Delta z_{m,t}$. As a result, the quality of the communication of the signal receiving system of the present invention would be degraded in case of instability of zeros $z_{m,t}$.

When the number (N) of antenna units 11 is an odd number, the quantitative measure ($Q_{present\text{-}odd}$) of the effect of the weight quantization error on the array pattern function $\tilde{P}(u)$ is as shown in Equation (14). On the other hand, when the number (N) of antenna units 11 is an even number, the quantitative measure ($Q_{present\text{-}even}$) of the effect of the weight quantization error on the array pattern function $\tilde{P}(u)$ is as shown in Equation (15):

$$Q_{present\text{-}odd} = \sum_{t=1}^{T}\sum_{m=1}^{2}\left|\sum_{x=0}^{2}\frac{\partial z_{m,t}}{\partial w_{x,t}}\Delta w_{x,t}\right| = \sum_{t=1}^{T}\left[\left|\frac{\Delta w_{0,t} + \Delta w_{1,t}z_{1,t} + \Delta w_{2,t}z_{1,t}^2}{w_{2,t}(z_{1,t} - z_{2,t})}\right| + \left|\frac{\Delta w_{0,t} + \Delta w_{1,t}z_{2,t} + \Delta w_{2,t}z_{2,t}^2}{w_{2,t}(z_{2,t} - z_{1,t})}\right|\right] \tag{14}$$

$$Q_{present\text{-}even} = \sum_{t=1}^{T-1}\left[\left|\frac{\Delta w_{0,t} + \Delta w_{1,t}z_{1,t} + \Delta w_{2,t}z_{1,t}^2}{w_{2t}(z_{1,t} - z_{2,t})}\right| + \left|\frac{\Delta w_{0,t} + \Delta w_{1,t}z_{2,t} + \Delta w_{2,t}z_{2,t}^2}{w_{2,t}(z_{2,t} - z_{1,t})}\right|\right] + \left|\frac{\Delta w_{0,T} + z_{1,T}\Delta w_{1,T}}{w_{1,T}}\right| \tag{15}$$

As shown in Equations (14) and (15), it is evident that the quantitative measures ($Q_{present\text{-}odd}$), ($Q_{present\text{-}even}$) of the effect of the weight quantization error on the array pattern function $\tilde{P}(u)$ obtained by the present invention are affected by a distance between the two zeros $z_{1,t}$, $z_{2,t}$ of each of the combining stages $STAGE_t$ (t=1, 2 . . . T), i.e., ($z_{1,t}$–$z_{2,t}$). In comparison, the quantitative measure ($Q_{prior}$) of the effect of the weight quantization error on the array pattern function P(u) obtained by the prior art (as shown in Equation (4)) is controlled by the product of the distances between each pair of the zeros, i.e., the $$\prod_{k=1,k\neq i}^{N-1}(z_i - z_k).$$

In view of this, the sensitivity of the zero displacements $\Delta z_{m,t}$ due to the weight quantization errors $\Delta w_{x,t}$ in the present invention is significantly smaller than that in the prior art.

Simulation Verification

Figure 5:
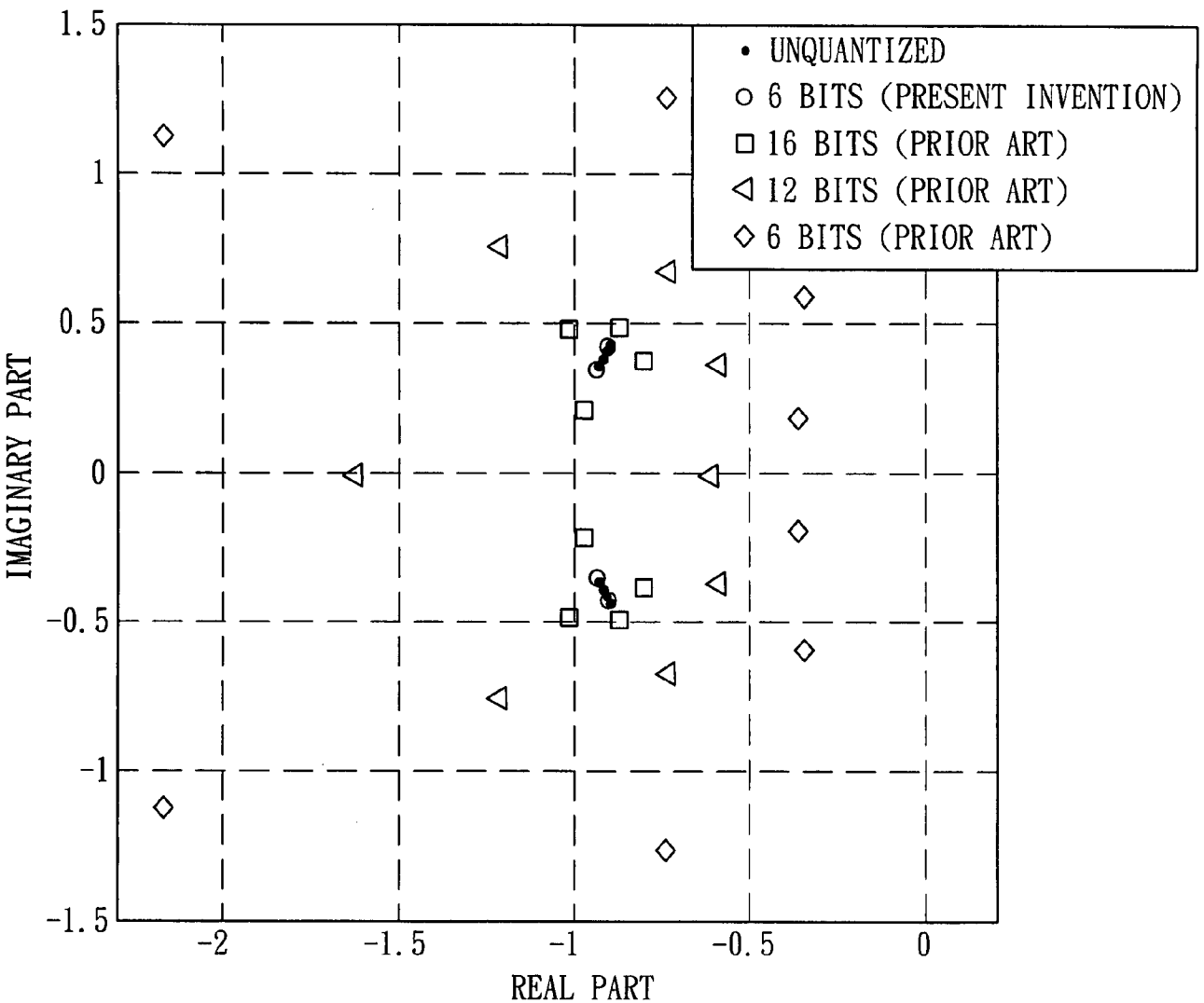
FIG. 5 is a simulation result diagram, illustrating a plurality of zeros of an array pattern function obtained by the present invention and by the conventional smart antenna using weights of varying quantization wordlengths.

FIG. 5 illustrates a simulation result of the zeros of the array pattern functions obtained by the present invention and for the prior art using weights of varying quantization wordlengths, and plotted in terms of real and imaginary parts of the zeros. In FIG. 5, symbol "•" denotes the zeros of the array pattern function obtained using unquantized weights (ideal), where a plurality of the zeros are tightly clustered. Symbols "□", "◁", "◇" denote the zeros $z_i$ of the array pattern function P(u) obtained by the prior art when the quantization wordlengths for the weights $w_n$ are 16 bits, 12 bits, and 6 bits, respectively. It can be seen that the zeros $z_i$ have greater displacements as the quantization wordlength of the weights $w_n$ decreases (in this case from 16 bits to 12 bits to 6 bits). In contrast, the zeros $\tilde{z}_{m,t}$ of the array pattern function $\tilde{P}(u)$ obtained by the present invention when the quantization wordlength for the weights $w_{x,t}$ is 6 bits, as denoted by symbol "○", are only slightly displaced from the unquantized zeros as denoted by symbol "•" even with such a small quantization wordlength. In fact, even with a quantization wordlength of 6 bits for the weights $w_{x,t}$, the displacements of zeros $\tilde{z}_{m,t}$ of the array pattern function $\tilde{P}(u)$ obtained by the present invention are still smaller than those obtained by the prior art with a quantization word length of 16 bits for the weights. In other words, the zeros $\tilde{z}_{m,t}$ of the array pattern function $\tilde{P}(u)$ obtained by the present invention are much less sensitive to the weight quantization than those obtained by the prior art.

Figure 6:
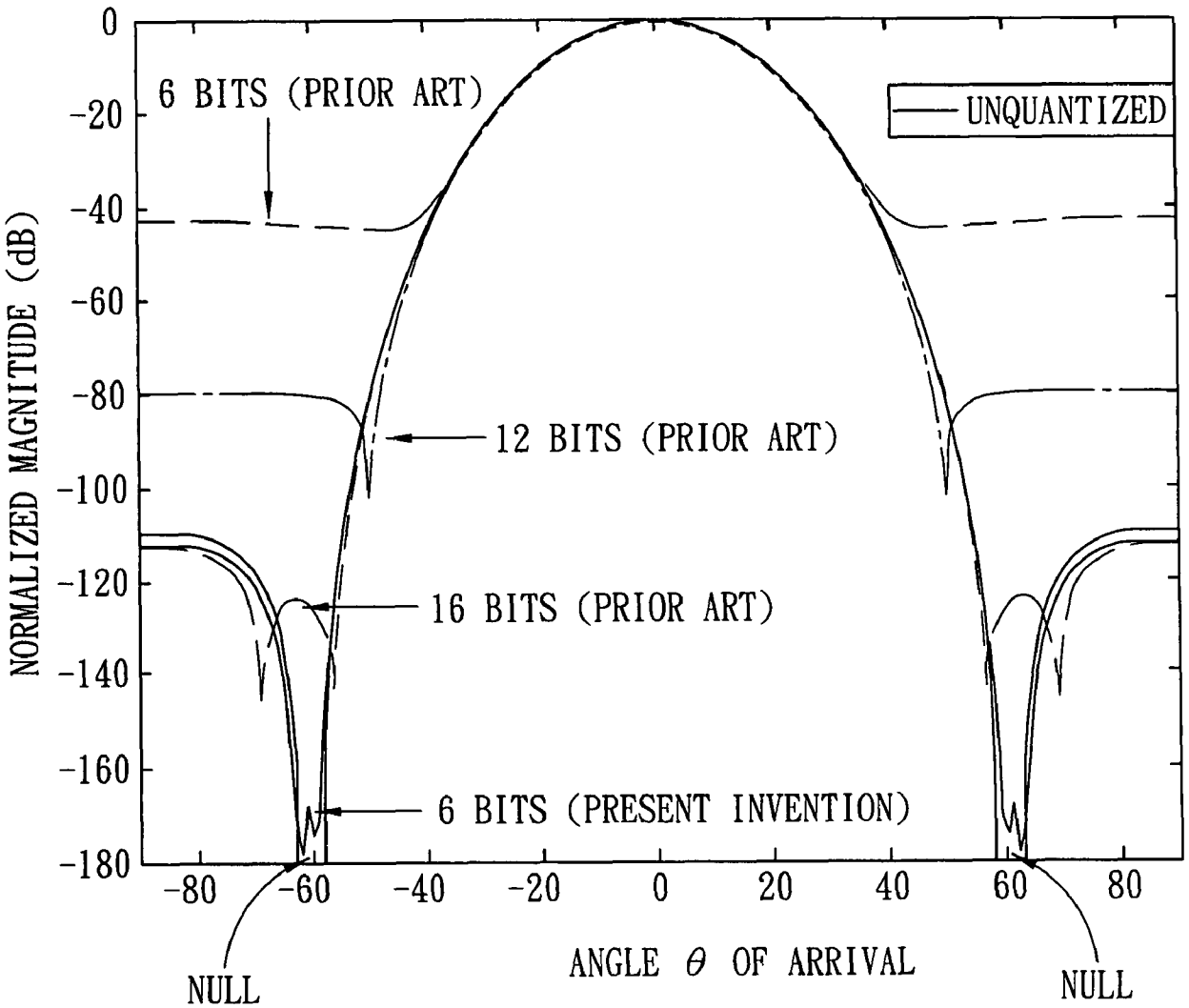
FIG. 6 is a simulation result diagram, illustrating normalized magnitude responses of the array pattern function obtained using unquantized weights, and obtained by the present invention and the prior art using quantized weights with different quantization wordlengths.

FIG. 6 illustrates a simulation result diagram for normalized magnitude responses of the array pattern functions obtained by both the prior art and by the present invention with respect to the arrival angle (θ). In the ideal situation, as shown by the solid line in FIG. 6, the normalized magnitude response for the array pattern function obtained using unquantized weights includes a main lobe and two side lobes that are weaker than the main lobe by more than 100 dB, and that form nulls smaller than −160 dB with the main lobe. The normalized magnitude response for the array pattern function P(u) obtained by the prior art using a quantization wordlength of up to 16 bits for the weights $w_n$ is still not sufficient to accurately represent the ideal normalized magnitude response, because a "notch" characteristic formed by the nulls is no longer present. In addition, as the quantization wordlength of the weights $w_n$ decreases, the normalized magnitude response obtained by the prior art deviates significantly from the ideal normalized magnitude response such that the difference between the main lobe and the side lobes is reduced to less than 80 dB, or even less than 50 dB. In contrast, the normalized magnitude response for the array pattern function $\tilde{P}(u)$ obtained by the present invention using a quantization wordlength of 6 bits for the weights $w_{x,t}$ is sufficiently close to the ideal normalized magnitude response, where nulls are maintained at less than −160 dB.

Figure 7:
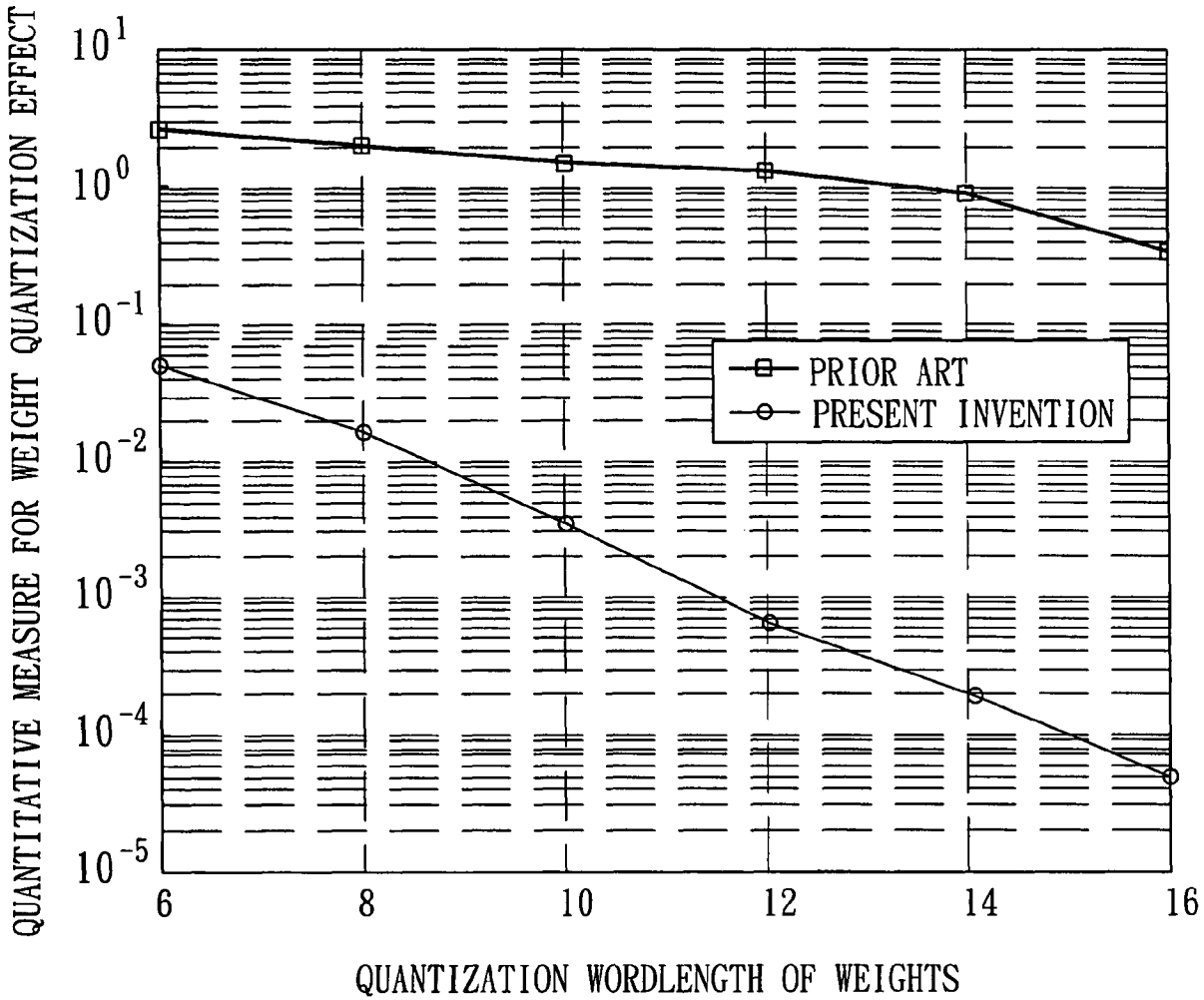
FIG. 7 is a simulation result diagram, illustrating quantitative measures for the effect of weight quantization error on the array pattern function for the present invention and the prior art with respect to the quantization wordlength of the weights.

Referring to FIG. 7, the quantitative measure ($Q_{prior}$) for the effect of the weight quantization error on the array pattern function P(u) implemented by the prior art, and the quantitative measure ($Q_{present\text{-}odd}$) for the effect of the weight quantization error on the array pattern function $\tilde{P}(u)$ obtained by the present invention when the number (N) of antenna units 11 is an odd number are plotted against the quantized wordlength (in bit size) of the weights $w_n$, $w_{x,t}$. It is evident from FIG. 7 that the effect of increasing the quantization wordlength of the weights $w_n$ on the improvement of the quantitative measure ($Q_{prior}$) for the effect of the weight quantization error on the array pattern function P(u) obtained by the prior art is quite minimal. On the contrary, the quantitative measure ($Q_{present\text{-}odd}$) for the effect of the weight quantization error on the array pattern function $\tilde{P}(u)$ obtained by the present invention improves significantly with the increase in the quantization wordlength of the weights $w_{x,t}$. Moreover, the quantitative measure ($Q_{present\text{-}odd}$) obtained by the present invention using a quantization wordlength of 6 bits for the weights $w_{x,t}$ is better than the quantitative measure ($Q_{prior}$) obtained by the conventional smart antenna 8 using a quantization wordlength of 16 bits for the weights $w_n$. In other words, the performance of the present invention is better than that of the prior art.

It should be noted herein that, although the beamformer 2 of this embodiment combines signals using second-order factors, the present invention should not be limited thereto, i.e., third-order factors or higher-order factors can be implemented depending on the number (N) of the antenna units 11 incorporated in the particular application. Moreover, the beamformer 2 can be implemented independently of the signal receiving system.

In sum, the signal receiving system of the present invention combines signals received by the antenna units 11 in a cascading manner, in which each of the combining stages ($STAGE_t$) (t=1, 2 . . . T) uses second-order factors to combine the signals. In such a manner, the sensitivity of the zero displacements $\Delta z_{mt}$ due to the weight quantization error $\Delta w_{xt}$ is significantly reduced as compared to the prior art. Even in the case where a plurality of the zeros $z_{mt}$ of the array pattern function $\tilde{P}(u)$ are tightly clustered, the resultant zero displacements $\Delta z_{mt}$ are still significantly smaller than those of the prior art. Consequently, the quality of communication is improved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A signal receiving system comprising:

an antenna array including a plurality of uniformly spaced apart antenna units;

a weight generator for generating a plurality of weights; and a beamformer for combining arrival signals outputted by said antenna units and outputting an array pattern, said beamformer including a number (T) of consecutive combining stages, a $T^{th}$ one of said combining stages including a converging unit, each of first to $(T-1)^{th}$ ones of said combining stages including a plurality of converging units, the number of said converging units in a preceding one of said combining stages of said beamformer being greater than that of a succeeding one of said combining stages of said beamformer, each of said converging units in the first one of said combining stages combining at least three of the arrival signals in accordance with corresponding ones of the weights from said weight generator so as to form an output signal, each of said converging units in each of second to $(T-1)^{th}$ ones of said combining stages combining output signals of at least three corresponding ones of said converging units in an immediately preceding one of said combining stages in accordance with corresponding ones of the weights from said weight generator so as to form an output signal, said converging unit of the $T^{th}$ one of said combining stages combining the output signals from said converging units in the $(T-1)^{th}$ one of said combining stages in accordance with corresponding ones of the weights from said weight generator so as to form an output signal that serves as the array pattern.

2. The signal receiving system as claimed in claim 1, wherein each of said converging units in the first one of said combining stages receives three corresponding ones of the arrival signals, each of said converging units in each of the second to $(T-1)^{th}$ ones of said combining stages receiving the output signals of three corresponding ones of said converging units in the immediately preceding one of said combining stages, the three signals received by each of said converging units in the first to $(T-1)^{th}$ one of said combining stages being combined in a second-order factor relation.

3. The signal receiving system as claimed in claim 2, wherein said antenna array includes a number (N) of said antenna units, each of which outputs a respective one of the arrival signals, the number of said converging units in an $i^{th}$ one of said combining stages of said beamformer being N−2i, where i=1 to T−1, the output signal of each of said converging units in the first one of said combining stages being a weighted sum of the three corresponding ones of the arrival signals from three adjacent ones of said antenna units.

4. The signal receiving system as claimed in claim 3, wherein the three arrival signals received by each of said converging units in the first one of said combining stages are combined in a ratio of $1:u^1:u^2$, where $u=\exp[j2\pi d \sin(\theta)/\lambda]$, d is an antenna spacing between an adjacent pair of said antenna units, λ is the wavelength of a corresponding one of the arrival signals, and θ is the angle of a corresponding one of the arrival signals relative to a broadside of said antenna array;

the three output signals received by each of said converging units in the second to $(T-1)^{th}$ ones of said combining stages being combined in the ratio of $1:u^1:u^2$.

5. The signal receiving system as claimed in claim 1, wherein said weight generator provides a same set of quantized weights to each of said converging units in a same one of said combining stages, and each of said converging units generates the output signal as a weighted sum of the signals received thereby in accordance with the quantized weights provided thereto by said weight generator.

6. A beamformer adapted for receiving arrival signals from an antenna array and a plurality of weights, said beamformer being adapted for combining the arrival signals and outputting an array pattern, said beamformer comprising:

a number (T) of consecutive combining stages, a $T^{th}$ one of said combining stages including a converging unit, each of first to $(T-1)^{th}$ ones of said combining stages including a plurality of converging units, the number of said converging units in a preceding one of said combining stages being greater than that of a succeeding one of said combining stages;

each of said converging units in the first one of said combining stages combining at least three of the arrival signals in accordance with corresponding ones of the weights so as to form an output signal, each of said converging units in each of second to $(T-1)^{th}$ ones of said combining stages combining output signals of at least three corresponding ones of said converging units in an immediately preceding one of said combining stages in accordance with corresponding ones of the weights so as to form an output signal, said converging unit of the $T^{th}$ one of said combining stages combining the output signals from said converging units in the $(T-1)^{th}$ one of said combining stages in accordance with corresponding ones of the weights so as to form an output signal that serves as the array pattern.

7. The beamformer as claimed in claim 6, wherein each of said converging units in the first one of said combining stages receives three corresponding ones of the arrival signals, each of said converging units in each of the second to $(T-1)^{th}$ ones of said combining stages receiving the output signals of three corresponding ones of said converging units in the immediately preceding one of said combining stages, the three signals received by each of said converging units in the first to $(T-1)^{th}$ one of said combining stages being combined in a second-order factor relation.

8. The beamformer as claimed in claim 7, the antenna array including a number (N) of antenna units, each of which outputs a respective one of the arrival signals, wherein the number of said converging units in an $i^{th}$ one of said combining stages of said beamformer is N−2i, where i=1 to T−1, the output signal of each of said converging units in the first one of said combining stages being a weighted sum of the three corresponding ones of the arrival signals from three adjacent ones of the antenna units.

9. The beamformer as claimed in claim 8, wherein the three arrival signals received by each of said converging units in the first one of said combining stages are combined in a ratio of $1:u^1:u^2$, where $u=\exp[j2\pi d \sin(\theta)/\lambda]$, d is an antenna spacing between an adjacent pair of the antenna units, λ is the wavelength of a corresponding one of the arrival signals, and θ is the angle of a corresponding one of the arrival signals relative to a broadside of the antenna array;

the three output signals received by each of said converging units in the second to $(T-1)^{th}$ ones of said combining stages being combined in the ratio of $1:u^1:u^2$.

10. The beamformer as claimed in claim 6, wherein a same set of quantized weights is provided to each of said converging units in a same one of said combining stages, and each of said converging units generates the output signal as a weighted sum of the signals received thereby in accordance with the quantized weights provided thereto.

* * * * *